United States Patent [19]

Pardo

[11] Patent Number: 4,756,039

[45] Date of Patent: Jul. 12, 1988

[54] BROOM

[75] Inventor: John Pardo, Yonkers, N.Y.

[73] Assignee: The Drackett Company, Cincinnati, Ohio

[21] Appl. No.: 66,799

[22] Filed: Jun. 25, 1987

[51] Int. Cl.[4] ..... A46B 9/00; A46B 9/08

[52] U.S. Cl. ..... 15/160; 15/159 R; 15/DIG. 5; 15/DIG. 6

[58] Field of Search ..... 15/189, DIG. 5, DIG. 6, 15/193, 159 R, 160, 106, 168, 171

[56] References Cited

U.S. PATENT DOCUMENTS

| | | | |
|---|---|---|---|
| 1,530,753 | 3/1925 | Carrey | 15/106 X |
| 2,043,758 | 6/1936 | Lay | 15/159 R |
| 4,042,995 | 8/1977 | Varon | 15/159 A |
| 4,250,589 | 2/1981 | Alvin | 15/193 |
| 4,385,411 | 5/1983 | Clark | 15/160 |

FOREIGN PATENT DOCUMENTS

| | | | |
|---|---|---|---|
| 20288 | of 1898 | United Kingdom | 15/159 R |
| 26024 | of 1905 | United Kingdom | 15/159 R |
| 515233 | 11/1939 | United Kingdom | 15/106 |

*Primary Examiner*—Peter Feldman

*Attorney, Agent, or Firm*—Gene Warzecha

[57] ABSTRACT

A bristle broom is provided with a plurality of relatively flexible, soft bristles the ends of which form the majority of the broom's sweeping surface, and a smaller number of relatively inflexible, stiff bristles the ends of which form a small portion of the sweeping surface adjacent one end thereof. The stiff bristles improve the broom's sweeping efficiency in corners and edges or in removing stubborn dirt while the remainder of the bristles retain the conventional sweeping efficiency of flat bristle brooms.

1 Claim, 1 Drawing Sheet

BROOM

BACKGROUND OF THE INVENTION

1. Field of the Invention

The invention relates generally to bristle brooms. In particular, the invention relates to angled-cut brooms wherein the sweeping surface of the bristles is generally oblique to the broom handle.

2. Description of the Prior Art

Angled-cut bristle brooms are generally well-known. They may be made of broom corn as shown in U.S. Pat. No. 246,500 (Hall) or of synthetic or vegetable fibers as shown in U.S. Pat. No. 4,250,589 (Alvin).

One of the main advantages of such brooms is that the sweeping surface formed by the ends of the broom bristles is oriented obliquely to the broom handle such that it bears uniformly against the floor along the whole length of the sweeping surface when the broom is in use. This not only enables all of the bristles to be evenly worn during use, but also facilitates sweeping corners and edges.

However, all known angled-cut brooms, as well as more traditional flat or straight-cut brooms whose sweeping surfaces are perpendicular to the broom handle, have bristles of uniform stiffness. In straight-cut brooms this inherent characteristic results in no differentiation between the sweeping ability of the broom tip (farthest from the user) or the rear end of the broom sweeping surface closest to the user, assuming, of course, that the straight-cut broom is used so as to have the entire sweeping surface bear evenly against the surface being swept. If the bristles are of uniform stiffness and relatively flexible or soft in order to be suitable for flat floor surfaces, the softness inhibits sweeping efficiency in corners and edges. Conversely, if the bristles are of uniform stiffness and relatively inflexible or hard enough to sweep corners and edges well, the broom would be inefficient for flat surfaces.

In known angled-cut brooms the use of bristles having uniform stiffness results in different considerations. For any given bristle stiffness, shorter bristles are stiffer and less flexible than longer bristles. Thus, in known angled-cut brooms having bristles of uniform stiffness and progressively increasing lengths, the tip of the broom is more flexible than the rear of the broom. Consequently, in sweeping floor edges or corners where dirt tends to accumulate, even the use of known angled-cut brooms is not particularly advantageous. There is, therefore, a need to overcome the deficiencies of the prior art by producing a broom which can be efficiently used on flat surfaces as well as corners and edges.

It is known in the prior art to combine bristles of different stiffnesses in one broom or brush. U.S. Pat. No. 2,043,758 (Lay) discloses a push broom having a forward row of coarse bristles and a rear row of finer bristles, the sweeping surfaces of both sets of bristles being inclined to lay flat upon the floor as the broom is pushed forward in normal use. U.S. Pat. No. 4,037,369 (Campbell) discloses a rotary floor maintenance brush combining bristles of varying degrees of coarseness. U.S. Pat. No. 237,154 (Armstrong) discloses a dust brush having a center core of relatively stiff bristles surrounded by a softer outer part. U.S. Pat. No. 430,077 (Jenness) discloses an animal grooming brush having bristles of varying degrees of stiffness arranged in generally concentric elliptical patterns. However, none of the foregoing prior art discloses use of a combination of stiff and soft bristles in the unique manner of the invention.

In view of the foregoing, it is an object of this invention to provide a broom having a combination of bristles of varying stiffness to enable efficient sweeping of flat surfaces as well as corners and edges.

It is a further object of this invention to provide an angled-cut broom having an oblique sweeping surface, the bristles adjacent the tip of the sweeping surface being stiffer than the remaining bristles.

SUMMARY OF THE INVENTION

These and other objects of the invention are achieved by the preferred embodiment thereof which is, in a bristle broom wherein the ends of the bristles form a longitudinal, planar sweeping surface, the improvement comprising a plurality of bristles adjacent one end of the sweeping surface being of a stiffness greater than that of the other bristles. It must be noted that the invention improves the efficiency of both straight-cut and angled-cut brooms. In one embodiment of the invention the broom is an angled-cut broom wherein the sweeping surface is oblique to the handle of the broom and the improvement comprises a plurality of the bristles adjacent the tip of the sweeping surface being of a stiffness greater than that of the other bristles.

DESCRIPTION OF THE PREFERRED EMBODIMENT

Figure 1:
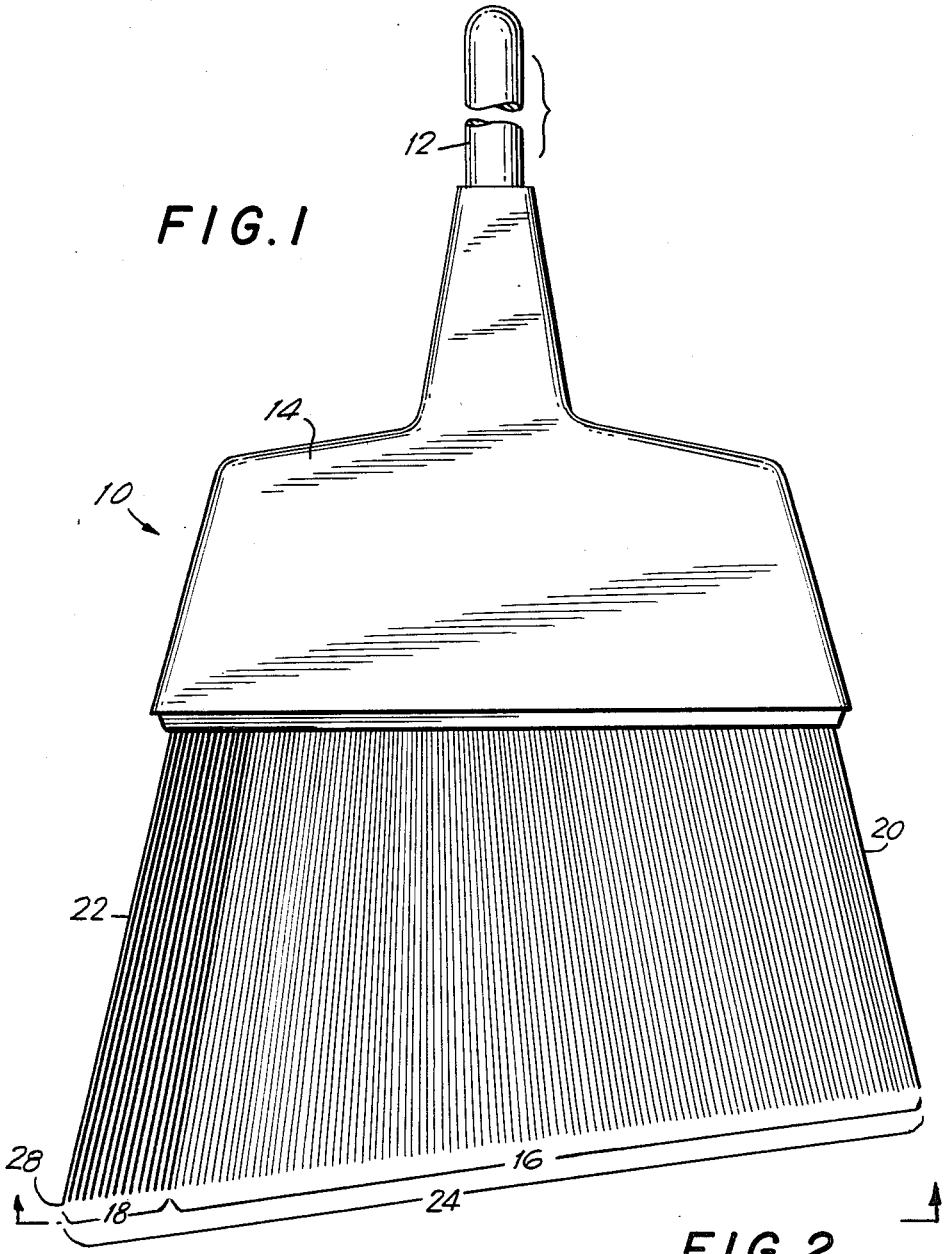
FIG. 1 is a side elevational view of a broom constructed in accordance with the principles of this invention.

FIG. 1 is a side elevational view of an angled-cut broom 10 constructed in accordance with the principles of this invention. Broom 10 includes a handle 12 and bristle shroud 14 which may be molded in a conventional manner from polystyrene or other suitable material. A plurality of bristles 16 and 18 are retained within and extend transversely from shroud 14 in a manner well known to those skilled in the art. The bristles are of two distinct types and are formed into two groups. Bristles 16 are made of a relatively flexible, soft material while bristles 18 are relatively stiffer than bristles 16. Bristles 16 and 18 may be made of well-known synthetic compositions conventionally extruded through cylindrical dies of two different sizes. Alternatively, bristles 16 and 18 may be made with identical cross-sections, but of materials having different flexibility characteristics.

In the preferred embodiment, the bristles along one side 20 of the broom are shorter than the bristles along the other side 22. All of the bristles intermediate these two sides are, going from side 20 to side 22, of progressively increasing lengths so that the ends of the bristles form a sweeping surface 24 which is generally planar, yet oblique to handle 12. It will be understood that a similar oblique sweeping surface could be obtained with bristles of equal length if the shroud were oblique. The sweeping surface has a tip 28 formed from the ends of bristles 18. Tip 28 is that portion of the sweeping surface farthest away from the user during use.

Figure 2:
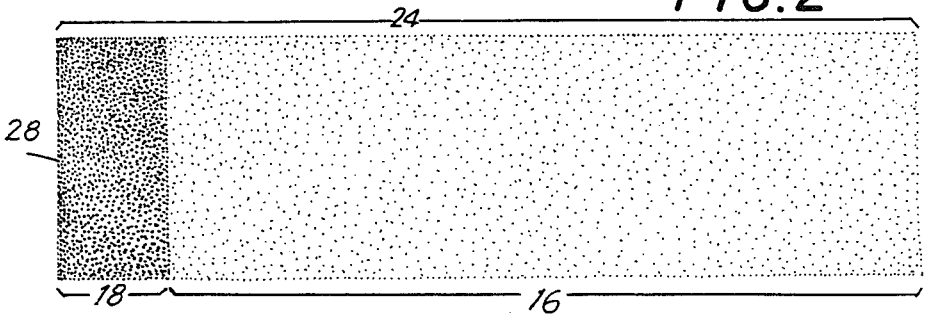
FIG. 2 is a view of the sweeping surface of the broom of FIG. 1, taken along the line 2—2 thereof.

The ends of bristles 16, which comprise the majority of sweeping surface 24 enhance the sweeping efficiency of broom 10 on flat surfaces. When it is desired to use the broom for corners and edges, tip 28 enhances sweeping efficiency in these areas because of the relative stiffness of bristles 18. If desired, the ends of bristles 16 and/or 18 may be flagged in a conventional manner. It will be understood that, while the sweeping surface 24 is shown diagrammatically in FIG. 2 as having a rectangular shape, the sweeping surface need not necessarily have this shape and may, because of the natural tendency of bristles to flare out from their point of attachment, be generally oval or elliptical as in conventional brooms.

It will be understood by those skilled in the art that numerous modifications and improvements may be made to the preferred embodiment of the invention disclosed herein without departing from the spirit and scope thereof.

What is claimed is:

1. In an angled-cut bristle broom wherein the ends of the bristles form a longitudinal, planar sweeping surface, the sweeping surface being oblique to the handle of said broom and having front and back portions, the bristles forming the front portion being longer than the bristles forming the back portion, the improvement comprising:

a predetermined number of the bristles adjacent the front portion of said sweeping surface being of a greater diameter than the other bristles in order to increase the stiffness of the front-portion-bristles over that of the other bristles.

* * * * *